US006729701B2

(12) United States Patent
Carter et al.

(10) Patent No.: US 6,729,701 B2
(45) Date of Patent: May 4, 2004

(54) SAFETY CABINET

(75) Inventors: Glen Alan Carter, Mattoon, IL (US); Steven Michael Eyer, Charleston, IL (US)

(73) Assignee: Justrite Manufacturing Company LLC, Des Plaines, IL (US)

( * ) Notice: Subject to any disclaimer, the term of this patent is extended or adjusted under 35 U.S.C. 154(b) by 0 days.

(21) Appl. No.: 09/896,273

(22) Filed: Jun. 29, 2001

(65) Prior Publication Data

US 2003/0001465 A1 Jan. 2, 2003

(51) Int. Cl.[7] ..... E05G 7/06

(52) U.S. Cl. ..... 312/222; 49/367; 292/35; 292/166; 312/409

(58) Field of Search ..... 312/222, 324, 312/409; 49/367, 395; 292/34, 35, 36, 38, 166

(56) References Cited

U.S. PATENT DOCUMENTS

| | | | | |
|---|---|---|---|---|
| 981,843 | A | | 1/1911 | Davis |
| 2,735,706 | A | | 2/1956 | Pelcin |
| 3,850,464 | A | | 11/1974 | Bisbing et al. |
| 4,146,994 | A | | 4/1979 | Williams |
| 4,262,448 | A | * | 4/1981 | Flider ..... 49/367 |
| 4,265,051 | A | | 5/1981 | Williams |
| 4,679,835 | A | | 7/1987 | Weinerman et al. |
| 4,892,338 | A | | 1/1990 | Weinerman et al. |
| 4,896,905 | A | | 1/1990 | Lehr et al. |
| 4,940,299 | A | | 7/1990 | Lazenby |
| 5,078,437 | A | | 1/1992 | Borgmeyer et al. |
| 5,121,952 | A | | 6/1992 | Jason |
| 5,158,329 | A | | 10/1992 | Schlack |
| 5,172,944 | A | | 12/1992 | Munich et al. |
| D347,155 | S | | 5/1994 | Schlack et al. |
| D357,396 | S | | 4/1995 | Ziemer et al. |
| D364,329 | S | | 11/1995 | Ziemer et al. |
| 5,473,845 | A | | 12/1995 | Livingston et al. |
| D370,620 | S | | 6/1996 | Ziemer |
| 5,603,535 | A | | 2/1997 | Antonucci et al. |
| 5,795,043 | A | * | 8/1998 | Johnson et al. ..... 312/229 |
| D399,121 | S | | 10/1998 | Alyanakian et al. |
| 5,878,608 | A | | 3/1999 | Alyanakian |
| 5,934,716 | A | | 8/1999 | Koveal et al. |
| 5,974,842 | A | | 11/1999 | Schlack et al. |
| 5,992,098 | A | | 11/1999 | Flider et al. |
| D419,053 | S | | 1/2000 | Schlack |
| 6,023,953 | A | | 2/2000 | Vickers et al. |
| 6,050,618 | A | | 4/2000 | Tieu |
| D425,395 | S | | 5/2000 | Ji |

FOREIGN PATENT DOCUMENTS

| | | |
|---|---|---|
| DE | 834348 | 3/1952 |
| FR | 2113501 | 6/1972 |

OTHER PUBLICATIONS

Ten photographs of a Safety Storage Cabinet made by SECURALL, LaPorte, Indiana, available to applicants Jul. 2000.

Four pages of internet brochure relating to storage cabinets, www.securallproducts.com, SECURALL, bearing copyright date of 2000.

* cited by examiner

*Primary Examiner*—Lanna Mai
*Assistant Examiner*—Jerry A Anderson
(74) *Attorney, Agent, or Firm*—Leydig, Voit & Mayer, Ltd.

(57) ABSTRACT

A safety cabinet is disclosed which includes an enclosure having a double-wall construciton and a pair of doors to selectively seal the enclosure. The safety cabinet includes a retaining system for retaining the doors in an open position and a closure system for automatically closing the doors. The safety cabinet also includes a latch system for selectively retaining the doors in a closed position to cover the enclosure. The latch system includes a paddle handle, first and second slide plates, a bullet slam latch, and first and second latch rod assemblies. The safety cabinet can be used to store, for example, flammable liquids, flammable waste, corrosives, pesticides, or combustible waste.

21 Claims, 14 Drawing Sheets

SAFETY CABINET

FIELD OF THE INVENTION

The present invention pertains generally to a safety cabinet for flammable, combustible, or other hazardous materials. More particularly, the present invention relates to a safety cabinet having a door with a latch system.

BACKGROUND OF THE INVENTION

A safety cabinet for storing flammable or explosive materials is known in the art. Such a safety cabinet located at a plant allows for the onsite storage of flammable material. The safety cabinet can be provided to insulate flammable material stored within it from the direct effects of an external fire to prevent the flammable material from adding to the deleterious effect of the original fire. Often, either according to law or to an internal standard operating procedure, the safety cabinet is equipped with a locking mechanism, which provides an added safety feature by preventing inadvertent, improper usage of the flammable material and by allowing access to the flammable material to be restricted only to authorized personnel. However, when a container of flammable material is stored in a lockable safety cabinet, users of the safety cabinet frequently neglect to lock up such material between uses. This failure to use the locking mechanism can be through oversight or through the preference for the convenience and heightened accessibility that result from the liquid being freely and readily available.

Previous safety cabinets have included a mechanism for automatically closing the door to increase the cabinet's functionality as a safety device. Thus, a safety cabinet was provided that automatically closes and latches the safety cabinet in response to conditions of combustion to eliminate the need for concern over the necessity for closing the cabinets.

Nonetheless, these devices are susceptible to accidental opening of the doors. Moreover, even when the cabinet doors are latched and locked, the handle, which protrudes from the door surface of the cabinet, can be easily broken by forklifts or other heavy machinery operating in such work environments where a safety cabinet may be found.

SUMMARY OF THE INVENTION

To provide improved control over the safety cabinet such that accidental opening of the cabinet or breakage of the cabinet can be minimized, the present invention provides a latch system having a paddle handle that is substantially flush with the outer surface of the door of the safety cabinet. The disposition of the paddle handle substantially flush with the outer door surface serves to minimize the occurrence of inadvertent operation of the handle to open the door and of damage to the handle. The latch system, in conjunction with an automatic door closure system, provides a simple and efficient way not only to latch the cabinet door but also to effectively selectively retain the door and the handle in a latched position. By presenting a substantially flush outer appearance, the handle effectively prevents accidental opening of the safety cabinet, yet it does so without significantly adding to the complexity of using the latch system. Furthermore, the substantially flush position of the handle minimizes the possibility of damage to the handle by incidental contact with the safety cabinet.

In one aspect of the present invention, a safety cabinet includes a door closure system which automatically closes and latches the door responsive to conditions of combustion. The safety cabinet includes an enclosure that defines an opening and a cavity. A door is rotatably attached to the enclosure, the door being rotatable between an open position and a closed position. When in the closed position, the door, covers the opening of the enclosure. The door includes an outer surface, a recess, a first opening, a second opening, and a third opening. A closure system is operably arranged with the door to bias the door to the closed position. A retaining system is provided to retain the door in the open position. The retaining device includes a fusible link, which is mounted to the door and the enclosure. The fusible link is constructed such that the fusible link will fuse when the ambient temperature is above a selected level to thereby detach the link from the enclosure to allow the closure system to move the door to the closed position.

A latch system is provided that includes a paddle handle, first and second slide plates, first and second latch rods, and a bullet slam latch. The paddle handle is disposed in the recess of the door such that the paddle handle is substantially flush with the outer surface of the door. The paddle handle includes an operating lever, a first linkage, an opposing second linkage, and a slide. The operating lever is accessible from the outer surface of the door and is moveable to an open position. The operating lever is operably arranged with the slide such that operating the handle moves the slide. The first and second linkages are journaled to the slide such that when the slide moves during movement of the operating lever to the open position, the first and second linkages move toward each other. The first and second linkages each include a pin. The first and second slide plates are slidably mounted to the first and second linkages, respectively, of the paddle handle.

The first and second slide plate both include an elongated slot having the pin of the first and second linkages, respectively, disposed therein. The first and second slide plates are each moveable over a selected range of travel with respect to the pin of the first and second linkages, respectively. The first and second latch rods are respectively mounted to the first and second slide plates and each has a bevel end with an inclined portion configured to engage the enclosure. A spring is provided adjacent each bevel end to bias the respective latch rod to an extended position such that the bevel end projects from the first and second openings, respectively, of the door. The latch rods are moveable over a range of travel between the extended position and a retracted position. The bullet slam latch is mounted to the slide of the paddle handle. The bullet slam latch includes a catch and a spring to bias the catch to an extended position such that the catch projects from a third opening of the door. The catch is moveable over a range of travel between the extended position and a retracted position.

These and other objects and advantages, as well as additional inventive features, of the present invention will become apparent to one of ordinary skill in the art upon reading the detailed description, in conjunction with the accompanying drawings, provided herein.

DETAILED DESCRIPTION OF EMBODIMENTS OF THE INVENTION

In the following description, reference is sometimes made to the "left," "right" "top," "bottom," or other regions of the safety cabinet and its various components. It should be understood that these terms are used solely for convenient reference, inasmuch as the safety cabinet may be used omnidirectionally.

Figure 1:
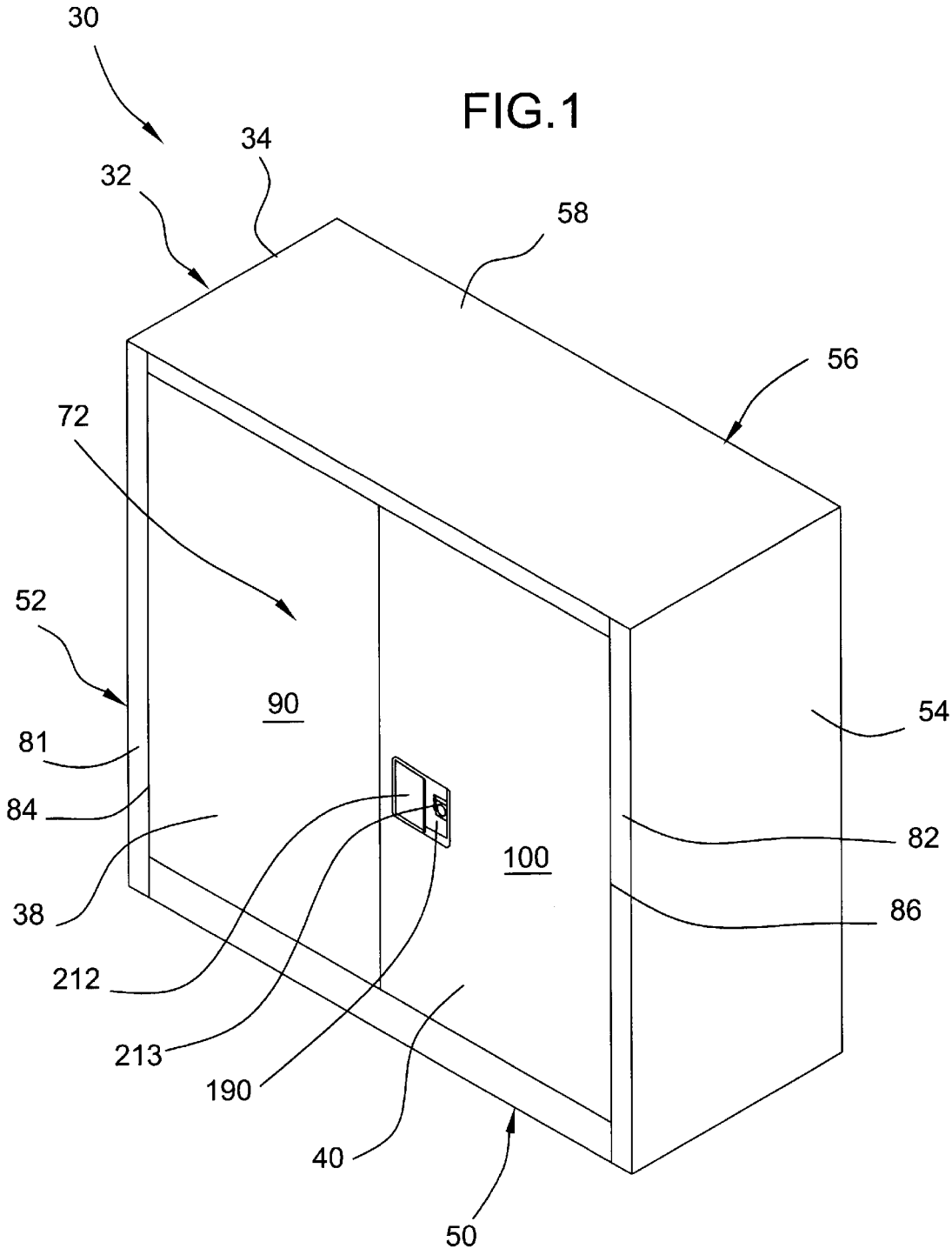
FIG. 1 is a perspective view of an embodiment of a safety cabinet having an embodiment of a latch system according to the present invention.
Figure 2:
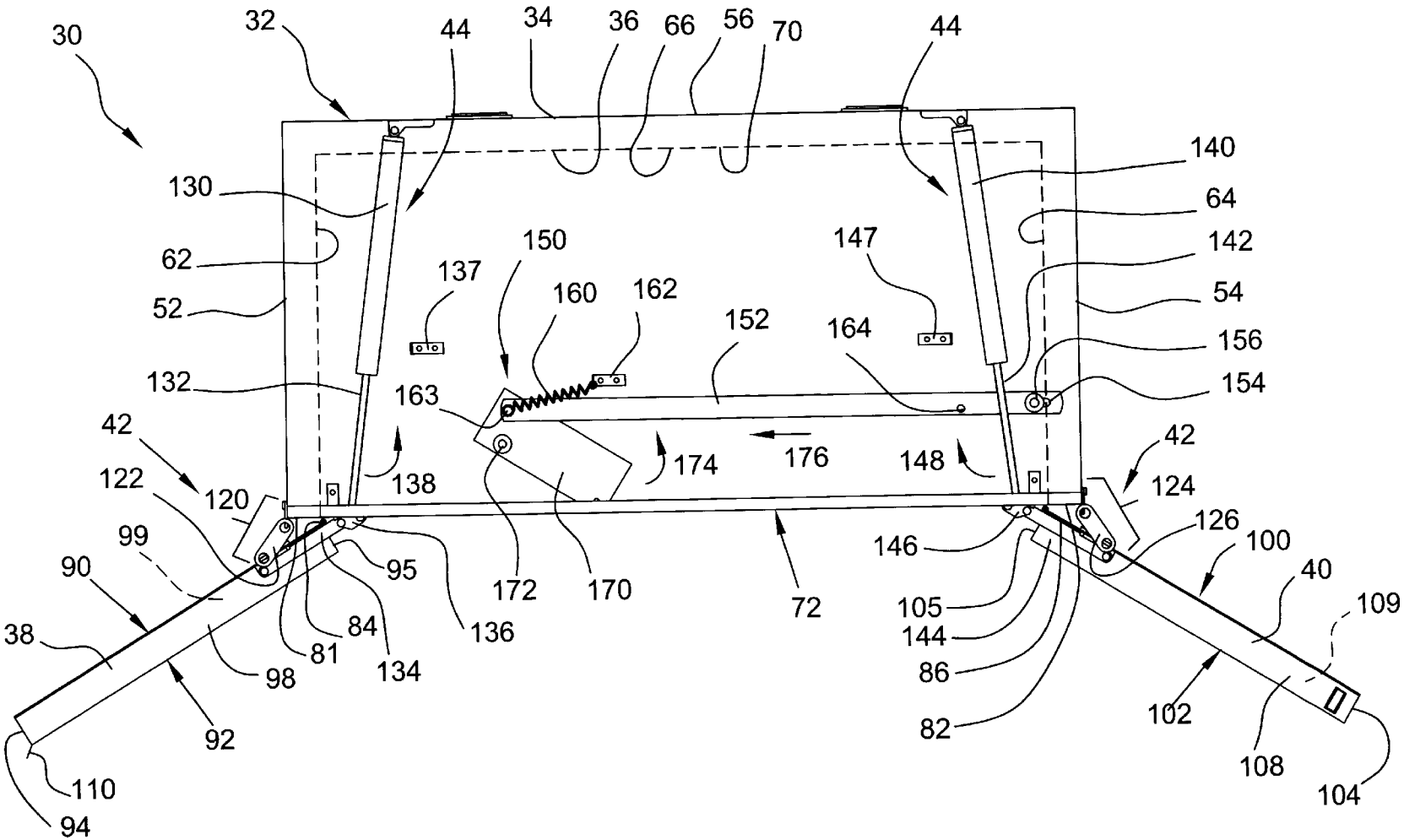
FIG. 2 is a top plan view of the safety cabinet of FIG. 1 that illustrates a pair of doors in an open position.
Figure 3:
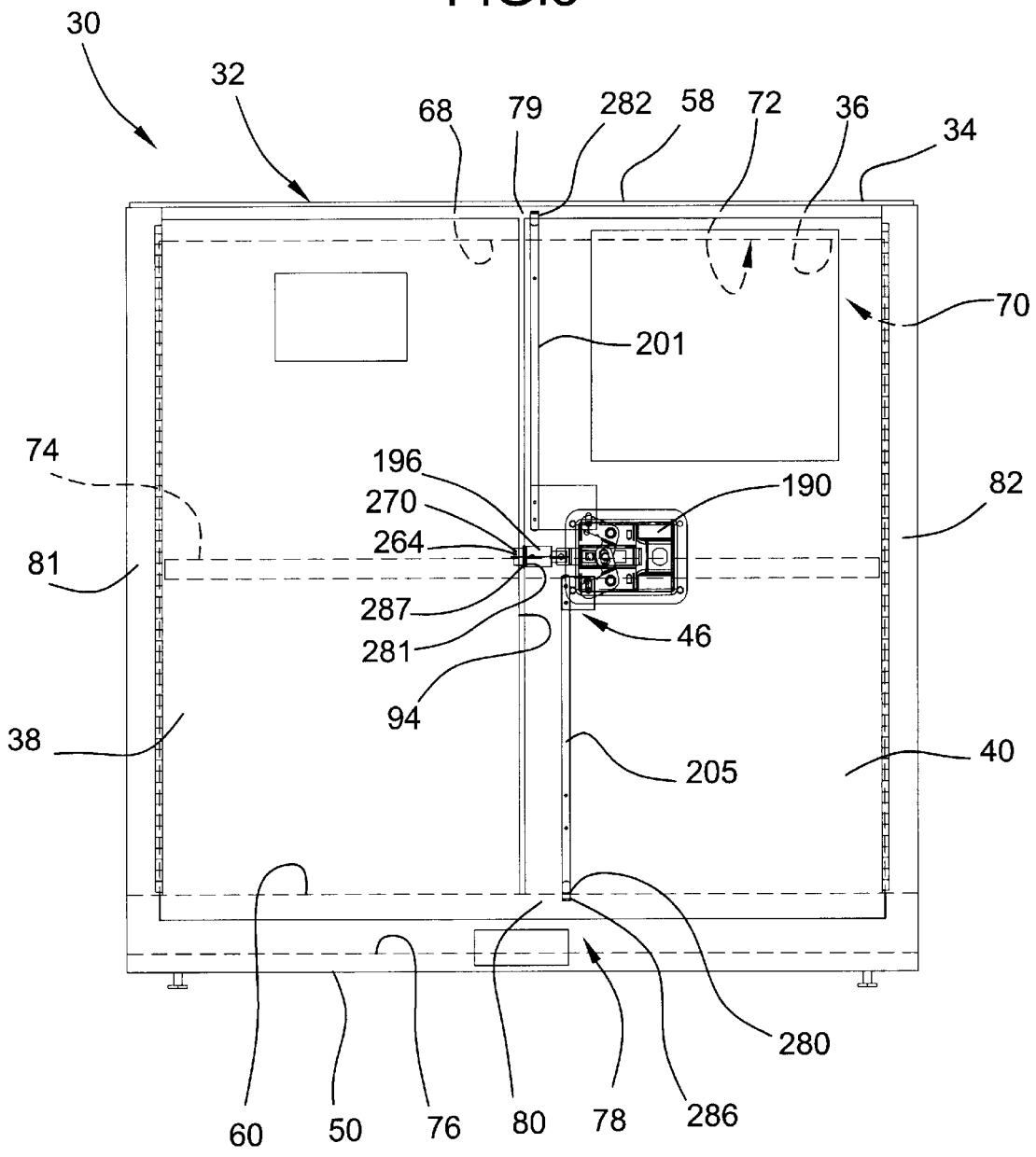
FIG. 3 is a front elevational view of the safety cabinet of FIG. 1.

Turning now to the drawings, there is shown in FIGS. 1–3 an illustrative fireproof safety cabinet 30 including an enclosure 32 having an outer shell 34 and an inner shell 36, a left door 38, and a right door 40. Referring to FIG. 2, the safety cabinet 30 includes a retaining system 42 for retaining the doors 38, 40 in an open position and a closure system 44 for automatically closing the doors 38, 40. Referring to FIG. 3, the safety cabinet 30 also includes a latch system 46 for latching the doors 38, 40 in a closed position to cover the enclosure 32. The safety cabinet 30 can be used to store, for example, flammable liquids, flammable waste, corrosives, pesticides, or combustible waste.

Referring to FIG. 1, the outer shell 34 includes an outer bottom wall 50, an outer left side wall 52, an outer right side wall 54, an outer rear wall 56, and an outer top wall 58. Referring to FIG. 2, the enclosure 32 includes the inner shell 36 to provide a double-walled construction, wherein each said outer wall of the outer shell 34 has a corresponding inner wall of the inner shell 36, with said inner and outer walls separated by a predetermined distance to define an insulative air space. The outer left and right side walls 52, 54 have corresponding inner left and right side walls 62, 64, respectively. The outer rear wall 56 has a corresponding inner rear wall 66.

Referring to FIG. 3, the outer bottom wall 50 has a corresponding inner bottom wall 60. The outer top wall 58 has a corresponding inner top wall 68. The inner shell 36 defines a cavity 70 that is accessible through an opening 72. In some embodiments a shelf 74, or a plurality of shelves, can be disposed in the cavity 70 to provide various storage options.

A liner surface 76 is disposed between the inner bottom surface 60 and the outer bottom surface 50 of the enclosure 32. The liner surface 76 is in spaced relation to the inner bottom surface 60 to define a sump area 78. The liner surface 76 provides a sealed surface that is liquid tight. The sump area 78 is provided to collect liquid that leaks from a vessel stored in the cabinet 30.

The enclosure 32 includes a top jamb 79, a bottom jamb 80, a left jamb 81, and a right jamb 82. The jambs 79, 80, 81, 82 bound the opening 72. It will be understood that the size of the enclosure 32 can be varied.

As best seen in FIGS. 1 and 2, the left and right doors 38, 40 selectively cover the opening 72 of the enclosure 32. Referring to FIG. 1, the left door 38 and the right door 40 are preferably rotatably mounted to the enclosure 32 by a respective left and right hinge 84, 86. The left and right doors 38, 40 can each move between a closed position and an open position. The left hinge 84 is mounted to the left jamb 81 of the enclosure 32 and the left door 38. The right hinge 86 is mounted to the right jamb 82 of the enclosure and the right door 40. The left and right hinges 84, 86 both extend substantially the full height of the respective door 38, 40. The left and right doors 38, 40 each has a double wall construction similar to the enclosure 32. It will be understood that in other embodiments, the safety cabinet can include a single door to selectively cover the opening of the enclosure.

Referring to FIG. 2, the left door 38 includes an outer door panel 90 and an inner door panel 92. The door panels 90, 92 are mounted to each other by a plurality of pop rivets, for example, or by another fastening technique known in the art. The outer door panel 90 includes first and second side walls 94, 95. The inner door panel 92 includes top and bottom walls 98, 99. The first and second side walls 94, 95, the top wall 98, and the bottom wall 99 define an insulative air space bounded by the inner and outer door panels 90, 92. The right door 40 is of construction similar to the left door 38 and includes an outer door panel 100 and an inner door panel 102. The outer door panel 100 of the right door 40 includes first and second side walls 104, 105. The inner door panel 102 of the right door 40 includes a top wall 108 and a bottom wall 109. The first and second side walls 104, 105, the top wall 108, and the bottom wall 109 define an insulative air space bounded by the inner and outer door panels 100, 102 of the right door 40.

The left door 38 includes a baffle 110 extending along substantially the entire height of the door 38 and projecting at an oblique angle from the intersection of the outer door panel 90 and the inner door panel 92 adjacent the first side wall 94.

Referring to FIG. 3, the outer door panels 90, 100 of the left and right doors 38, 40 overlap the opening 72 of the enclosure 32 along the top and bottom jambs 79, 80. Thus, when the left and right doors 38, 40 are closed, the cavity 70 of the enclosure 32 acts as an inner protected air space surrounded on the top, bottom, sides, rear and front by double-walled elements having insulating air spaces created therebetween. Thus articles placed within the cabinet 30 are protected from the effects of fire when the doors 38, 40 are closed.

Referring to FIG. 2, in use, the left and right doors 38, 40 can be manually moved by a user between the closed position and the open position shown in FIG. 2. The loading and unloading of the safety cabinet 30 are facilitated if the left and right doors 38, 40 remain in the open position. The retaining system 42 is provided to retain the left and right doors 38, 40 in the open position, as shown in FIG. 2. In a preferred embodiment, the retaining system 42 includes a first retaining element 120 with a first fusible link 122. The first retaining element 120 has a detent feature that acts to retain the left door 38 in the open position. The first fusible link 122 is mounted to the left door 38 and the enclosure 32. The fusible link 122 is constructed such that the fusible link 122 fuses, i.e., melts, when the ambient temperature is above a selected level to thereby detach the link from the enclosure 32 to allow the closure system 44 to move the door 38 to the closed position. The retaining system 42 includes a second retaining element 124 with a second fusible link 126. The second retaining element 124 is similar to the first retaining element 122 and is used to hold the right door 40 in the open position. The second fusible link 126 is similar to the first fusible link 120 and similarly provides means to release the right door 40 in the event of a rise in ambient temperature. The second link 126 is mounted to the right door 40 and the enclosure 32. In one embodiment of the fusible link, the link is constructed such that it will fuse when the ambient temperature is 165° F. In embodiments of the safety cabinet including a single door, the retaining system can include a single retaining element.

In use, the left and right doors 38, 40 can be moved from the closed position to the open position, which is shown in FIG. 2. The retaining system 42 acts to retain the left and right doors 38, 40 in the open position. The left and right doors 38, 40 can be moved to the closed position from the open position either manually by overcoming the retaining hold of the retaining elements 120, 124 or automatically by providing a means to automatically close the doors 38, 40 in the event that the fusible links 122, 126 melt.

The closure system 44 is provided to automatically close the doors 38, 40. In the illustrative embodiment, a first air cylinder 130, which includes a moveable piston 132, is rotatably mounted to the enclosure 32. A left linkage 134 is mounted to the left door 38 and rotatably mounted to a distal end 136 of the piston 132. The piston 132 of the first air cylinder 130 is configured to bias the left door 38 to the closed position. A first stop 137 is provided to limit the range over which the first air cylinder 130 can rotate in a closing direction 138. In a similar fashion as the first air cylinder 130, a second air cylinder 140, which includes a moveable piston 142, is rotatably mounted to the enclosure 32. A right linkage 144 is mounted to the right door 40 and rotatably mounted to a distal end 146 of the piston 142 of the second air cylinder 140. The piston 142 of the second air cylinder 140 is configured to bias the right door 40 to the closed position. A second stop 147 is provided to limit the range over which the second air cylinder 140 can rotate in a closing direction 148. it will be understood that in other embodiments, other biasing elements can be used in place of the first and second air cylinders 130, 140, such as, springs, for example.

In the event of fire, for instance, the closure system 44 cooperates with the fusible links 122, 126 to automatically close the doors 38, 40. When the ambient temperature exceeds the predetermined level, the first fusible link 122 and the second fusible link 126 melt. The first and second air cylinders 130, 140 can act to move the left and right doors 38, 40, respectively, to the closed position. The closure system 44 provides an assist feature during the manual closing of the doors 38, 40 by urging the doors 38, 40 to the closed position once the retaining system 42 is overcome.

As best seen in FIG. 2, once the left door 38 is closed, the right door 40 may then be closed to engage the baffle 110. Thus, during any closing of the left and right doors 38, 40, it is preferred that the doors 38, 40 close in sequence wherein the left door 38 reaches the closed position prior to the right door 40 doing so. It is also preferred that this sequence be maintained regardless of the sequence in which fusible links 122, 126 melt.

The illustrative embodiment of the closure system 44 of the safety cabinet 30 includes a timing mechanism 150 mounted to the enclosure 32 to control the sequence of the closing of the doors 38, 40 such that the left door 38 is placed in the closed position before the right door 40 is. The timing mechanism 150 is constructed in a fashion similar to the timing mechanism disclosed in U.S. Pat. No. 5,992,098, which is incorporated herein by reference in its entirety. The timing mechanism 150 includes a timing slide bracket 152 which is disposed between the outer and inner top walls of the enclosure 32. The timing slide bracket 152 includes a slot 154 and is slidably mounted upon a slide pivot pin 156, which is disposed in the slot 154. The timing slide bracket 152 is moveable over a range of travel that is defined by the dimensions of the slot 154.

A slide bracket spring 160 is attached to a spring anchor 162 and to an end 163 of the timing slide bracket 152 to bias the timing slide bracket 152 to a normal position, as shown in FIG. 2, with the slide pivot pin 156 positioned at the leftmost extreme of the slot 154. When the doors 38, 40 are in the open position, the timing slide bracket 152 is positioned in the normal position. A stop 164 is mounted to the timing slide bracket 152 and is disposed such that the stop 164 will contact the right linkage 144 as the right door 40 closes. In this manner, during the closing of the right door 40, the stop 164 engages the right linkage 144 such that the stop 164 selectively prevents the right door 40 from moving to the closed position.

An actuating plate 170 is pivotally mounted to the inner top wall of the enclosure 32 by a plate pivot pin 172 and is pivotally mounted to the timing slide bracket 152. When the actuating plate 170 is rotated in a closing direction 174, the timing slide bracket 152 is moved in a disengaging direction 176. The right door 40 will remain partially open until the timing slide bracket 152 moves leftward a sufficient distance to position the stop 164 out of the path of the right linkage 144.

In operation the doors 38, 40 are closed either manually or automatically by moving the doors 38, 40 from the open position to the closed position. The right door 40 can rotate toward the closed position until the right linkage 144 contacts the stop 164, thereby preventing further movement of the right door 40. The left door 38 can freely rotate from the open position toward the closed position until it engages the actuator plate 170. Continued movement of the left door 38 pivots the actuator plate 170 about the pin 172 in the closing direction 174 thereby drawing the timing slide bracket 152 in the disengaging direction 176, which moves the stop 164 out of the path of the right linkage 144. The left door 38 is moved to the closed position. The right door 40 completes its movement to the closed position. The timing mechanism 150 allows the left door 38, which includes the baffle 110, to move to the closed position before the right door 40 does. Such an arrangement allows the left and right doors 38, 40 to cooperate to provide a protective seal.

In embodiments of the safety cabinet including a single door, the closure system can include a single air cylinder, linkage, and stop. Such a closure system can also omit the timing mechanism 150.

Referring to FIG. 3, once closed, it is preferred that the doors 38, 40 remain closed for maximum safety. To provide automatic latching capability, the latch system 46 is provided. The latch system 46 is disposed in the right door 40. In the illustrative embodiment, the safety cabinet 30 includes both the left and right doors 38, 40. The latch system 46 can operate to latch both of the doors 38, 40 in the closed position. The latch system 46 is particularly useful in conjunction with the closure system 44 when the safety cabinet includes left and right doors 38, 40. The timing mechanism of the closure system 44 ensures that the left door is in the closed position prior to the right door being in the closed position. With that sequence in place, the latch system 46 can engage the left door 38 and the enclosure 32 to latch the right door 40 to the left door 38 and to the enclosure 32, thereby selectively retaining both the left door 38 and the right door 40 in the closed position.

Figure 4:
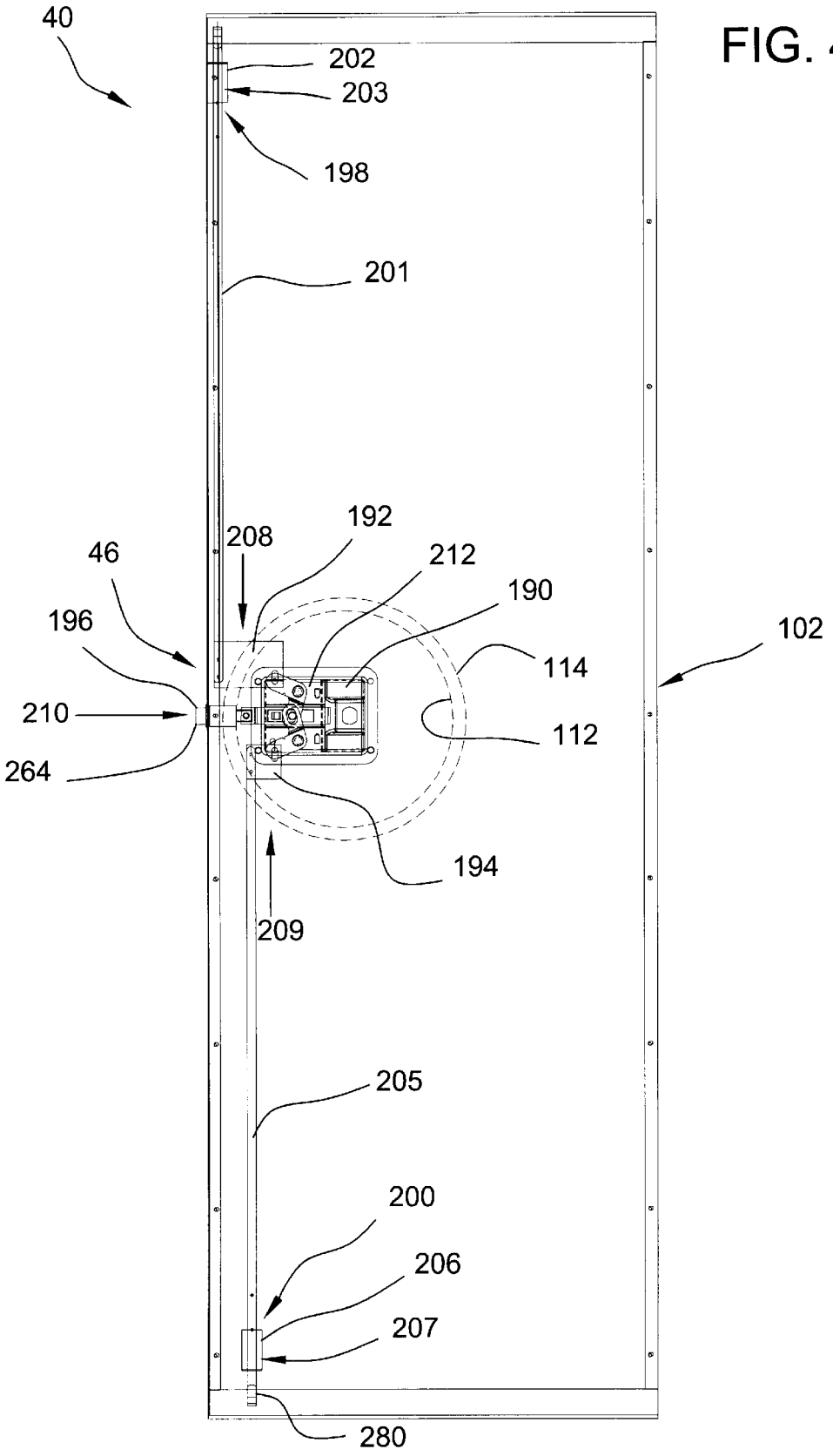
FIG. 4 is a front elevational view of the right door of FIG. 1, which includes the latch system.

Referring to FIG. 4, the latch system 46 of the preferred embodiment includes a paddle handle 190, first and second slide plates 192, 194, a bullet slam latch 196, and first and second latch rod assemblies 198, 200. The first latch rod assembly 198 includes a first latch rod 201, a latch guide bracket 202, and a spring 203. The second latch rod assembly 200 includes a second latch rod 205, a latch guide bracket 206, and a spring 207. The paddle handle 190 is operably arranged with the first and second slide plates 192, 194 and the bullet slam latch 196. The first and second latch rods 201, 205 are mounted to the first and second slide plates 192, 194, respectively. Actuating the paddle handle 190 moves the slide plates 192, 194 toward each other in opposing latch rod retracting directions 208, 209, respectively, which in turn moves the first and second latch rods 201, 205 to retracted positions. Actuating the paddle handle 190 also moves the bullet slam latch 196 in a slam latch retracting direction 210 to a retracted position. For ready access to the latch system 46 for maintenance, for example, the inner panel 102 of the right door 40 includes an access hole 112 covered by a removable cover plate 112. The access hole 112 is disposed such that the paddle handle 190, the slide plates 192, 194 and the bullet slam latch 196 are readily accessible through the hole 112.

Referring to FIG. 3, in the illustrative embodiment, the latch rods 201, 205 engage the top and bottom jambs 79, 80, respectively, of the enclosure and the bullet slam latch 196 engages the left door 38 to provide a three-point latch feature. When the door 40 is moved, either manually or automatically, into the closed position, the latch system 46 acts to automatically latch the door 40 without the operation of the paddle handle 190. The user need not move the paddle handle 190 to latch the doors 38, 40. The latch system 46 prevents the inadvertent opening of the doors 38, 40 and provides added safety by ensuring that the doors 38, 40 are retained in the closed position until the paddle handle 190 is operated.

Figure 5:
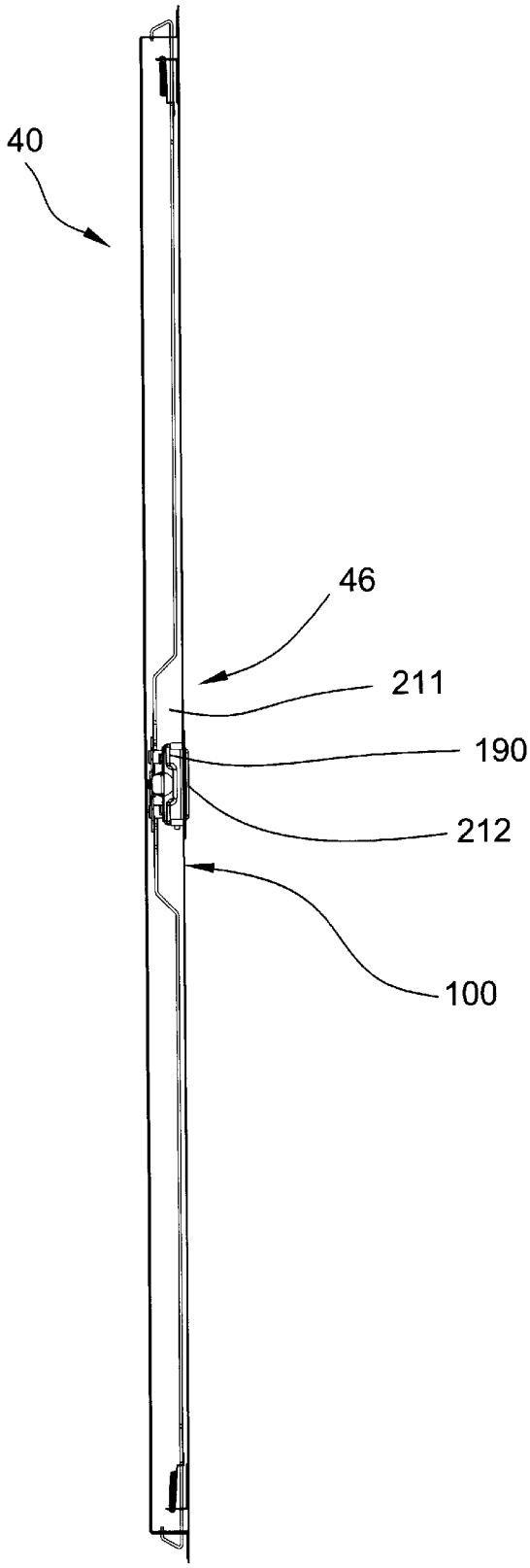
FIG. 5 is an end elevational view of the right door of FIG. 4.

Referring to FIG. 5, the paddle handle 190 is preferably disposed in a recess 211 of the door 40 such that the paddle handle 190 is substantially flush with the outer door panel 100 of the door 40. As best seen in FIG. 1, the paddle handle 190 includes an operating lever 212, which is accessible from the outer panel 100 of the door 40 and is moveable between a normal position and an operating position to actuate the paddle handle 190. The operating lever 212 is biased by a spring to the normal position, as shown in FIG. 1. When the operating lever 212 is in the normal position, the paddle handle 190 presents an outer surface that is substantially flush with the outer door panel 100 of the right door 40. The paddle handle 190 includes a key-operated lock 213, which selectively retains the operating lever 212 in the normal position to prevent the actuation of the paddle handle 190 for opening the left and right doors 38, 40.

Figure 6:
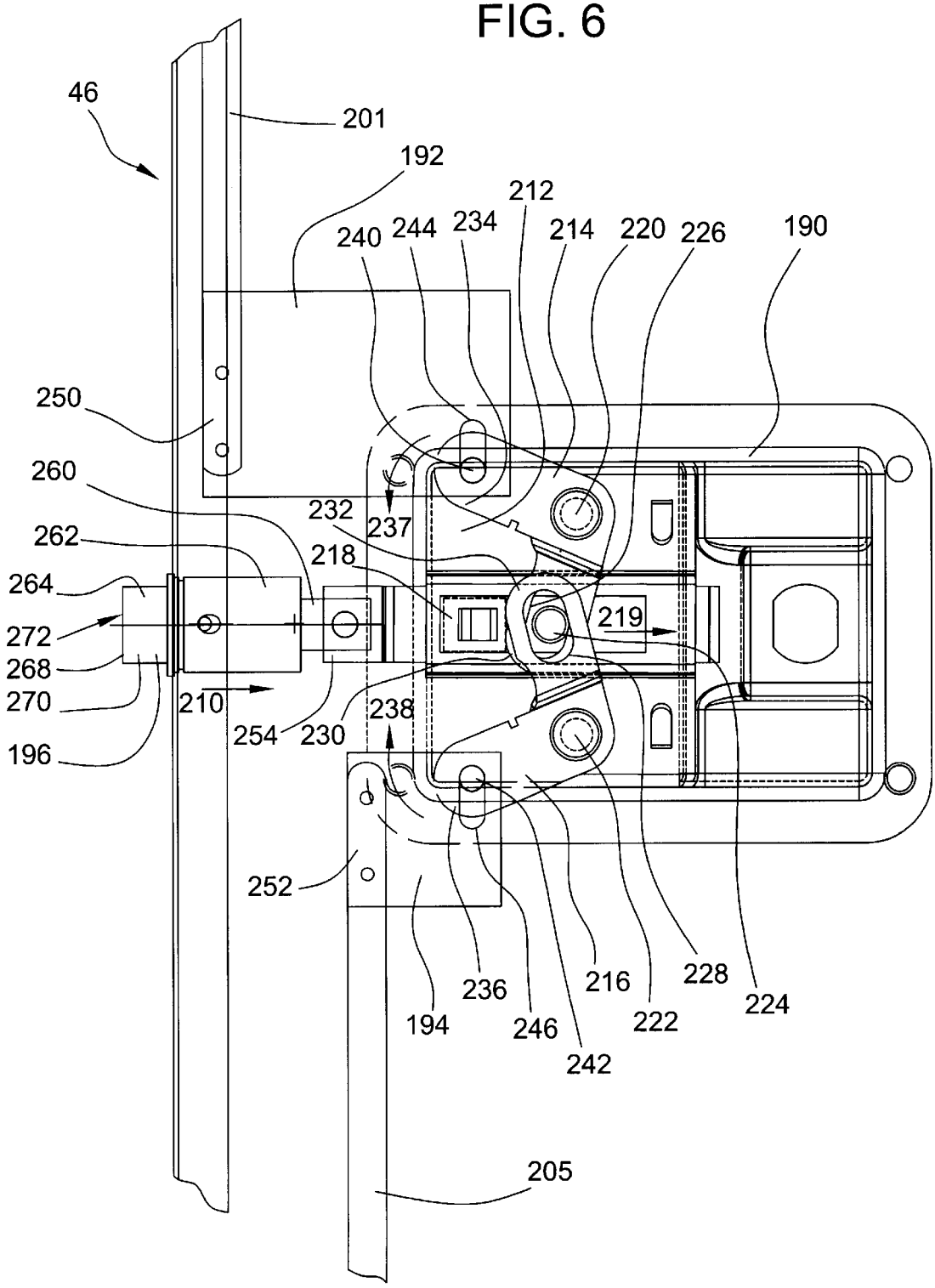
FIG. 6 is an enlarged, fragmentary front elevational view of the latch system of FIG. 1.

Referring to FIG. 6, the paddle handle 190 includes a first handle linkage 214, an opposing second handle linkage 216, and a slide 218. The operating lever 212 is operably arranged with the slide 218 such that moving the operating lever 212 to the operating position moves the slide 218 in a slide actuating direction 219. The first and second handle linkages 214, 216 are pivotally mounted to first and second linkage pivot pins 220, 222, respectively. The slide 218 includes a slide pin 224. The first and second linkages 214, 216 each include an elongated slot 226, 228 disposed at a respective proximal end 230, 232. The proximal ends 230, 232 of the first and second linkages 214, 216 are disposed in an overlapping manner such that the slots 226, 228 have the slide pin 224 disposed therein. The first and second handle linkages 214, 216 are journaled to the slide 218 by the slide pin 224 such that when the slide 218 moves in the slide actuating direction 219, distal ends 234, 236 of the first and second handle linkages 214, 216 rotate toward each other in opposing linkage actuating directions 237, 238, respectively.

The first and second slide plates 192, 194 are slidably mounted to the first and second linkages 214, 216, respectively, of the paddle handle 190. The first and second linkages 214, 216 each include a linkage pin 240, 242. The first and second slide plates 214, 216 each include an elongated slot 244, 246 having the pins 240, 242 of the first and second linkages 214, 216, respectively, disposed therein. The first and second slide plates 192, 194 each are moveable with respect to the pins 240, 242 of the first and second linkages 214, 216 over a selected range of travel defined by the dimensions of the slots 244, 246, respectively. The first and second latch rods 201, 205 are respectively mounted to first and second slide plates 192, 194 adjacent proximal ends 250, 252 of the latch rods 201, 205.

The bullet slam latch 196 is mounted adjacent to a distal end 254 of the slide 218. The bullet slam latch 196 includes a guide rod 260, a canister 262, and a catch 264. The guide rod 260 extends from the canister 262 and is mounted to the slide 218 of the paddle handle 190. The canister 262 is hollow and acts to house the guide rod 260 and the catch 264. The catch 264 provides a latch point for the latch system 46 to selectively retain the door 40 in the closed position. The catch 264 includes a catch pin and a tapered distal end 268 having a planar surface 270 and a rounded surface 272. The catch pin is disposed in a slot in the guide rod 260. The catch 264 is moveable over a range of travel between an extended position and a retracted position. The interplay between the catch pin and the guide rod slot defines the limits of travel of the catch. When the slide 218 of the paddle handle 190 moves in the slide actuating direction 219, the guide rod 260 moves in the slam latch retracting direction 210, thereby moving the catch 264 from the extended position to a retracted position. The bullet slam latch 196 includes a compression spring disposed inside the canister 262 to bias the catch 264 to the extended position such that the tapered distal end 268 projects from the door 40.

Figure 7:
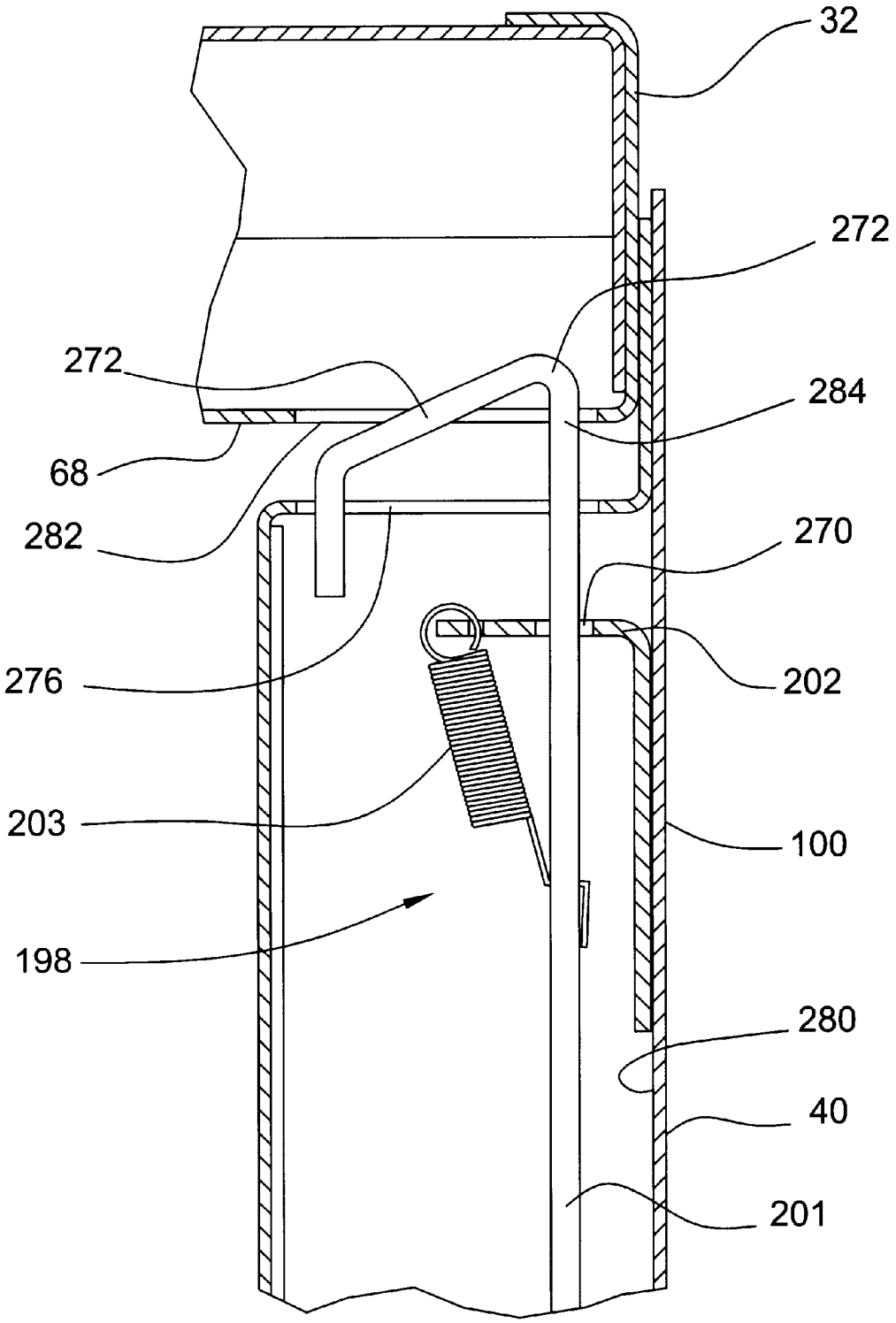
FIG. 7 is an enlarged, fragmentary end elevational view of a latch rod of the latch system of FIG. 1 in a latched position.

Referring to FIG. 7, the first latch rod assembly 198 is shown. The second latch rod assembly is constructed and operates in the same manner as the first latch rod assembly 198. Accordingly only the first latch rod assembly 198 will be discussed in detail. It will be understood that the description of the first latch rod assembly 198 is applicable to the second latch rod assembly. The first latch rod 201 extends through an aperture 270 in the latch guide bracket 202 and is movably disposed therein over a range of travel between a retracted position and an extended position. As shown in FIG. 7, the latch rod 201 is in the extended position. The first latch rod 201 has a distal bevel end 272 configured to engage the enclosure 32. The bevel end 272 provides a latch point for the latch system 46 to selectively retain the door in the closed position. The bevel end 272 includes an inclined portion 274.

The latch guide bracket 202 acts to control the direction of the movement of the first latch rod 201. The latch guide bracket 202 is mounted to an inner surface 280 of the outer door panel 100 of the right door 40. The spring 203 is provided adjacent the bevel end 272 to bias the first latch rod 201 to the extended position such that the bevel end 272 projects from a first opening 276 of the right door 40. The spring 203 is mounted to the first latch rod 201 and to the latch guide bracket 202.

The inner top wall 68 of the enclosure 32 includes an upper latch aperture 282 formed therethrough to register with the bevel end 272 of the first latch rod 201 when the right door 40 is in the closed position. The bevel end 272 protrudes through the upper latch aperture 282 when the right door 40 is in the closed position to provide a latch point to retain the right door 40 in the closed position. In the latched position, a straight portion 284 of the bevel end 272 engages the inner top wall 68 such that the right door 40 is latched in the closed position.

Referring to FIG. 3, a second opening 280 is provided in the right door 40 to accommodate the second latch rod 205. A lower latch aperture 286, which is similar to the upper latch aperture 282, is formed through the inner bottom wall 60 of the enclosure 32. Thus, in their extended positions, the first and second latch rods 201, 205 provide two latch points to retain the door 40 in the closed position. The catch 264 extends from a third opening 281 in the right door 40 when the catch 264 is in the extended position. A slam latch aperture 287 is disposed in the first side wall 94 of the left door 38. The slam latch aperture 287 is configured to align with the catch 264 of the bullet slam latch 196 when the left and right doors 38, 40 are in the closed position. The planar surface 270 of the catch 264 engages the slam latch aperture 287 to selectively retain the left door 38 in the closed position and to provide a third latch point to retain the right door 40 in the closed position. The latch rods 201, 205 and the slam latch 196 will remain in the latched position until a user operates the operating lever 212 of the paddle handle 190.

Figure 8:
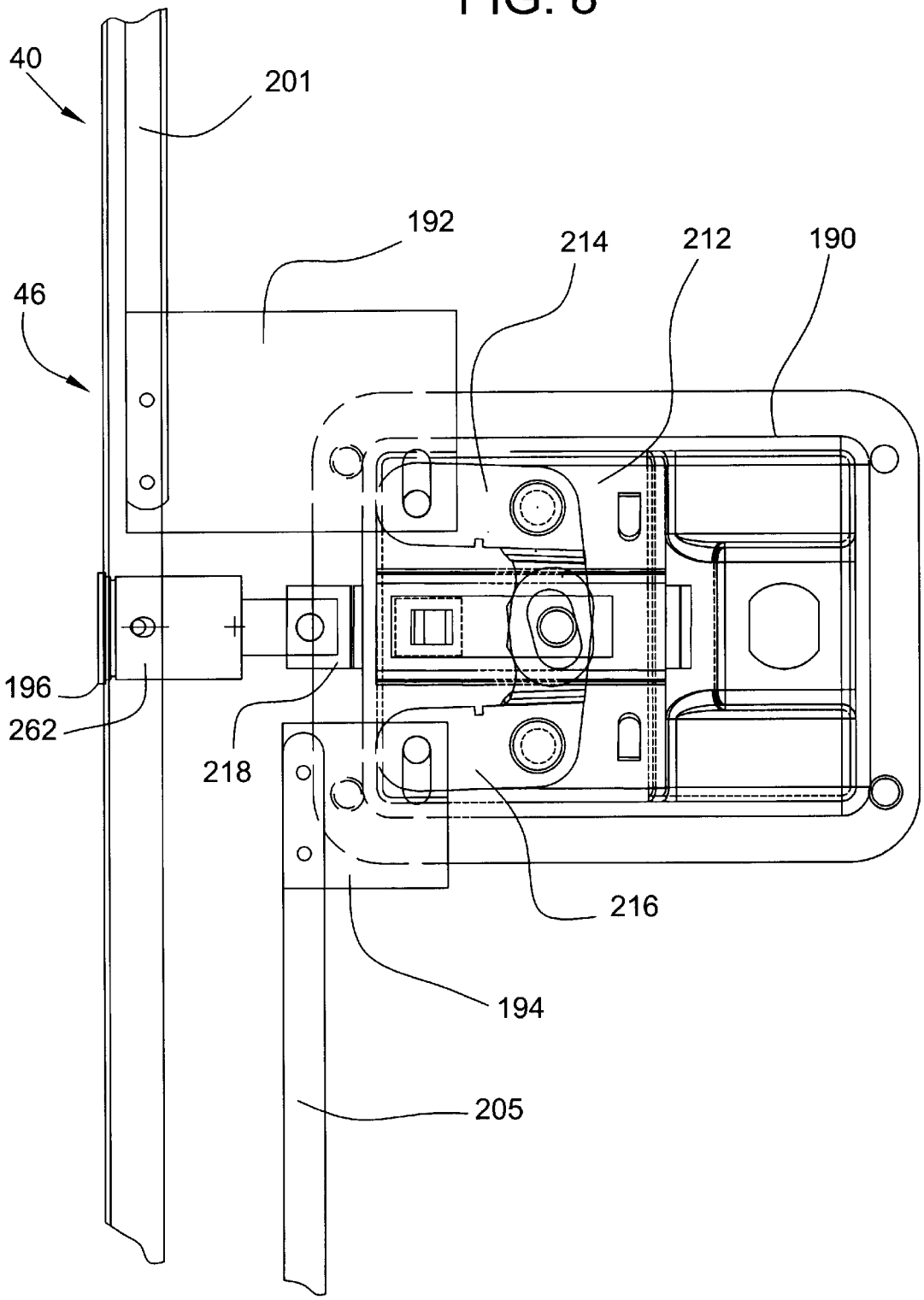
FIG. 8 is an enlarged, fragmentary front elevational view of the latch system of FIG. 1 that shows a paddle handle in an opened position.

Referring to FIG. 8, to open the door 40, a user operates the paddle handle 190 by pulling the operating lever 212 to move the slide 218 in the slide actuating direction 219, thereby retracting the catch of the bullet slam latch 196 and actuating the handle linkages 214, 216. The handle linkages 214, 216 move the slide plates 192, 194, respectively, toward each other. As shown in FIG. 8, the operating lever 212 is in the operating position. The latch rods 201, 205 and the bullet slam latch 196 are in the retracted positions and withdrawn from the associated apertures of the enclosure and the aperture of the left door, respectively. The door 40 can be moved to an open position.

The catch of the bullet slam latch 196 engages the spring disposed in the canister 262 to place the spring in compression. When the operating lever 212 of the paddle handle 190 is released from the operating position, the spring in the canister 262 returns to its normal position, thereby urging the catch to the extended position.

Figure 9:
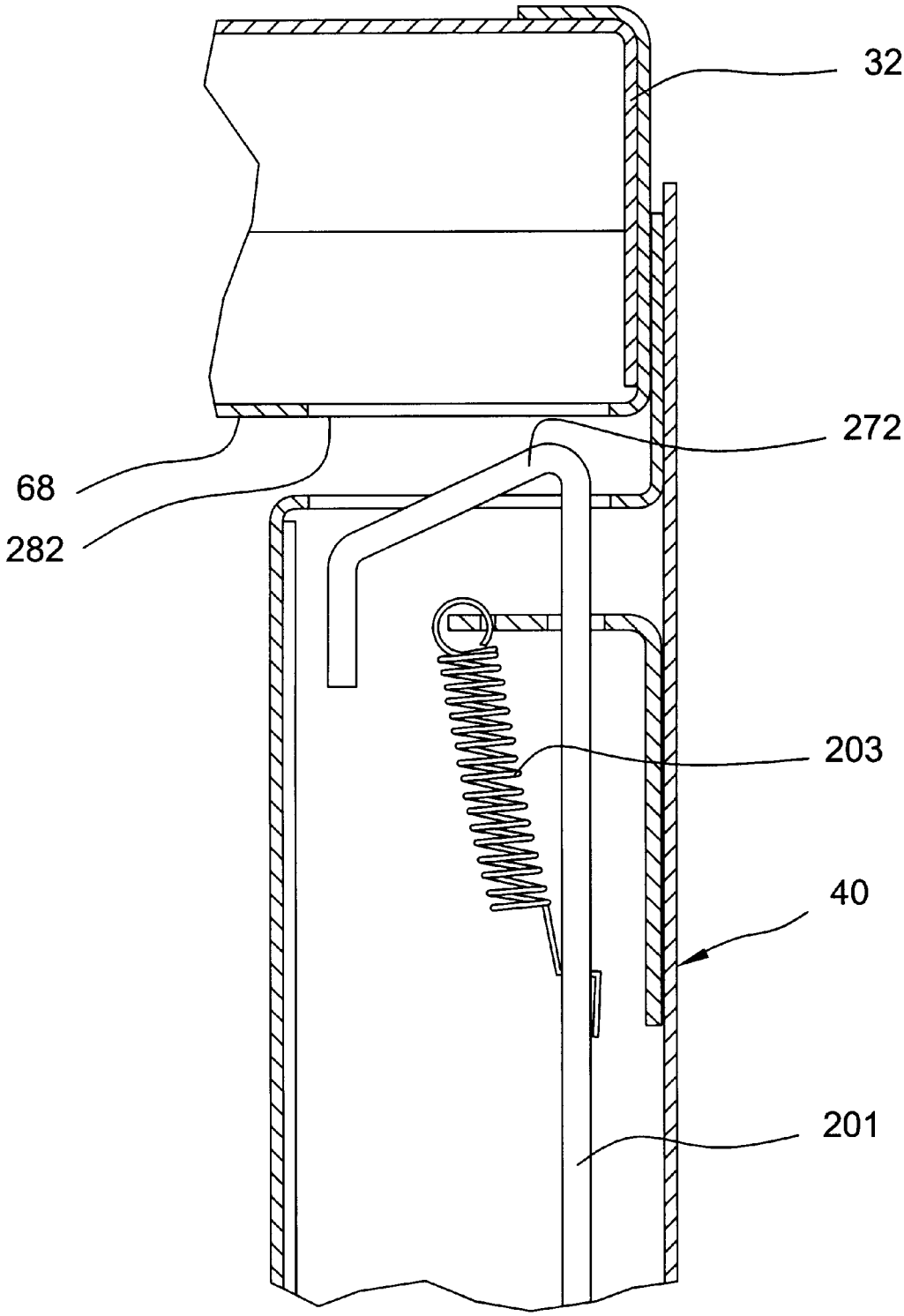
FIG. 9 is an enlarged, fragmentary front elevational view of the latch rod of FIG. 7 in a retracted position.

Referring to FIG. 9, the first latch rod 201 is in a retracted position. The bevel end 272 is removed from the upper latch aperture 282 and disengaged from the inner top wall 68 of the enclosure 32. The spring 203 is in tension and elongated from its normal position. The door 40 can be moved to an open position. When the operating lever of the paddle handle is released from the operating position, the spring 203 acts to urge the first latch rod 201 to the extended position. The second latch rod and its associated spring act in a similar manner.

By associating the operating lever 212 of the paddle handle 190 with a spring that urges the lever to the normal position and by associating the catch 264 of the slam latch 196 and the first and second latch rods 201, 205 with a respective spring that urges the catch and the rods to the extended positions, the latch system 46 provides another safety feature by facilitating the latching of the door in the closed position. With this arrangement, the operating lever returns to the normal position once the user releases it. When the door 40 is placed in the closed position and the operating lever 212 is in the normal position, the catch and the rods are urged to the extended position to retentively engage the left door and the enclosure, respectively. In the case where the latch rods 201, 205 and the catch 264 must be manually moved, the latch rods 201, 205 and the catch 264 can be left in the retracted position when the door 40 is in the closed position, thereby preventing the door 40 from being latched in the closed position.

Referring to FIG. 4, the latch system 46 provides further additional safety by facilitating the placement of the door 40 in the closed position by eliminating the necessity of manually moving the latch rods 201, 205 and the catch 264 of the bullet slam latch 196 to the retracted position during the movement of the door 40 to the closed position. In the case where the latch rods 201, 205 and the catch 264 of the slam latch 196 must be manually moved, the latch rods 201, 205 and the catch 264 can be left in the extended position when the door 40 is being moved to the closed position, thereby preventing the door 40 from being completely closed.

Figure 10:
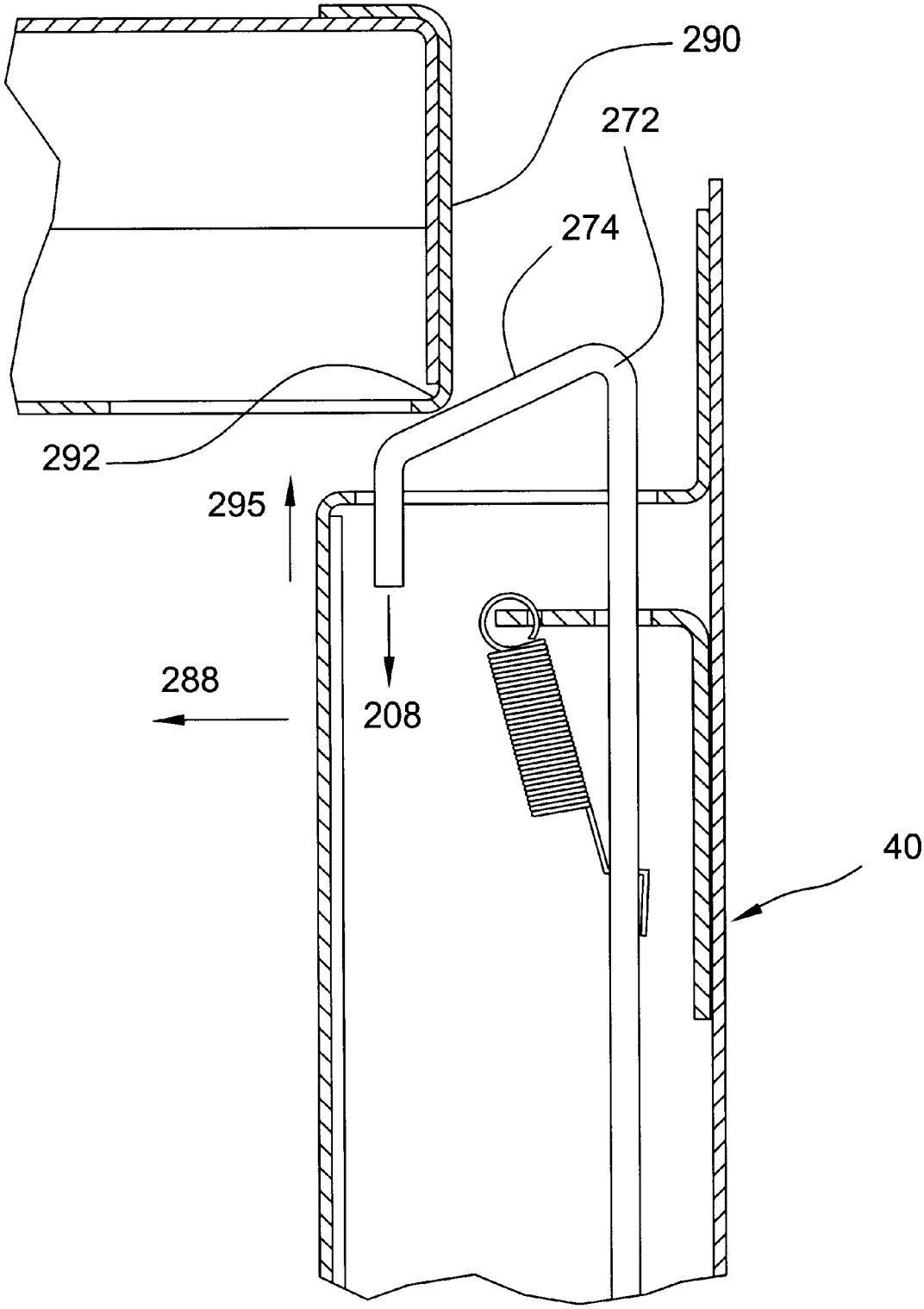
FIG. 10 is a view as in FIG. 9 that shows the right door disengaged from the enclosure.
Figure 11:
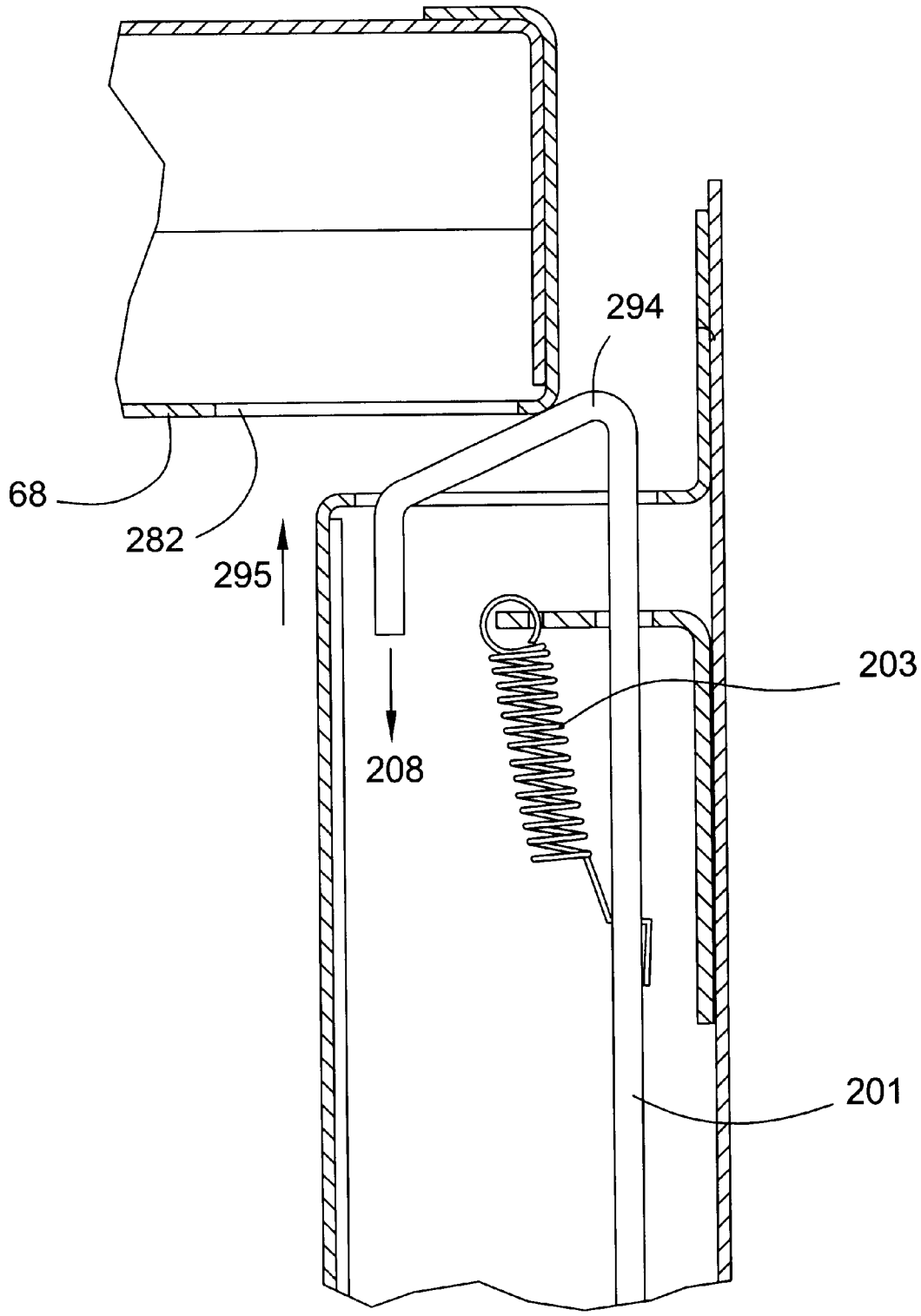
FIG. 11 is a view as in FIG. 9 that shows the latch rod engaged with the enclosure and in an intermediate position.
Figure 12:
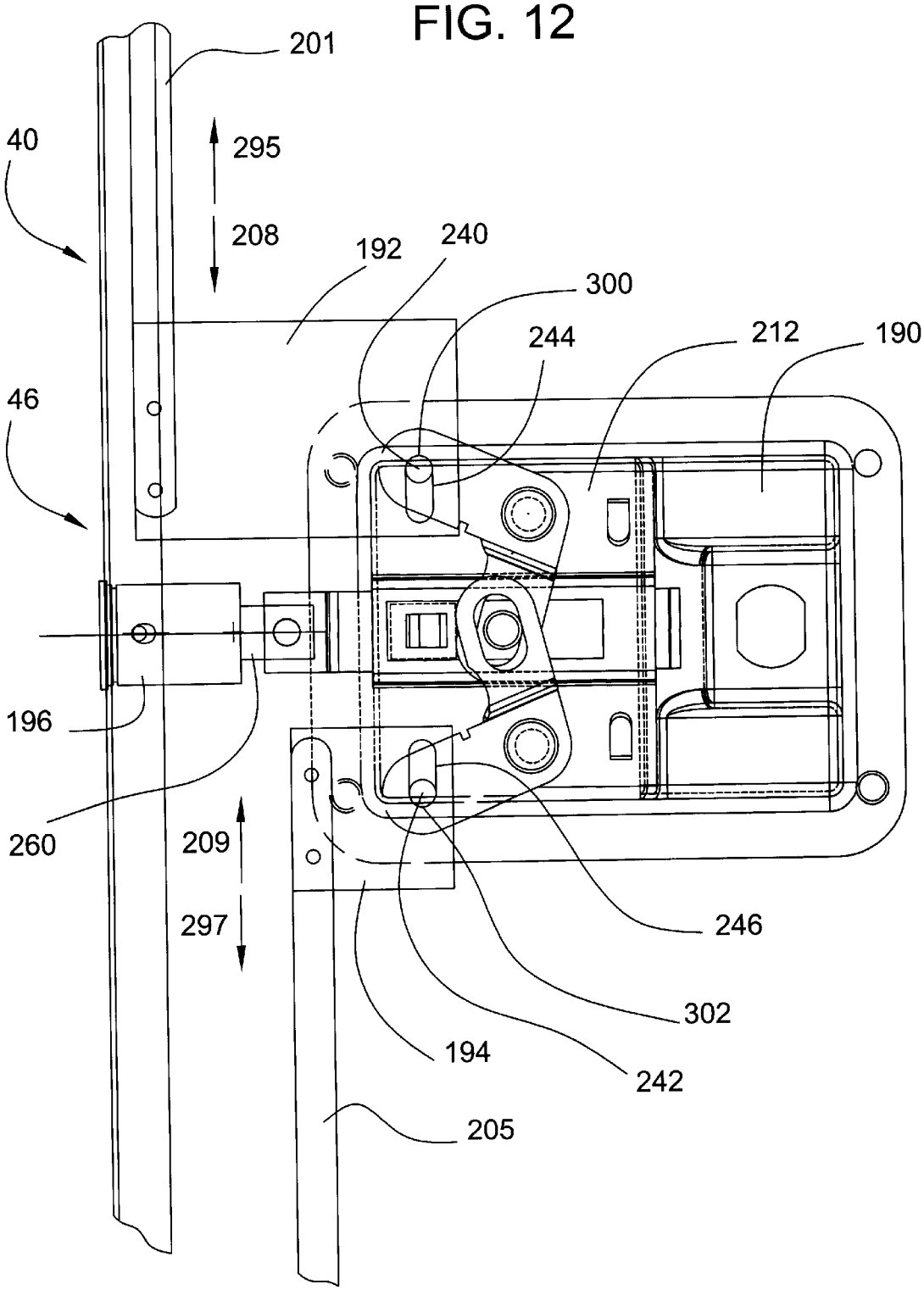
FIG. 12 is an enlarged, fragmentary front elevational view of the latch system of FIG. 1 that shows the latch rods in a retracted position.

Referring to FIGS. 10–12, the latch system 44 provides a three-point latching feature without the need to actuate the operating lever of the paddle handle during the closing of the door 40. Referring to FIG. 10, in operation, the right door 40 is manually or automatically moved to the closed position by moving the door 40 in a closing direction 288. The inclined portion 274 of the bevel end 272 engages an upper cabinet jamb 290. The inclined portion 274 bears against an edge 292 of the upper jamb 290 as the door 40 moves in the closing direction 288, which in turn moves the first latch rod 201 in the latch rod retracting direction 208 toward the retracted position. The bevel end of the second latch rod similarly engages a lower cabinet jamb to move the latch rod in the latch rod retracting direction that opposes the retracting direction 208 of the first latch rod 201.

Referring to FIG. 11, upon the application of a sufficient closing force, the first latch rod 201 moves in the latch rod retracting direction 208 to the retracted position. The latch rod 201 is shown in FIG. 11 in an intermediate position between the extended position and a retracted position. The spring 203 associated with the first latch rod 201 is placed in a tensioned position. Once a distal point 294 of the first latch rod 201 is aligned with the upper latch aperture 282 in the inner top wall 68, the spring 203 urges the first latch rod 201 in an extending direction 295 to the extended position, thereby providing a first point of latching, as shown in FIG. 7. In a similar fashion, the second latch rod and its associated spring cooperate to allow the second latch rod to move to a retracted position until the second latch rod is aligned with the lower latch aperture. Whereupon, the spring associated with the second latch rod urges the second latch rod to the extended position to provide a second point of latching.

Referring to FIG. 12, the slots 244, 246 provided in the first and second slide plates 192, 194 allow the first and second latch rods 201, 205 to move, respectively, in the retracting directions 208, 209. The slots 244, 246 define the range of travel over which the latch rods 201, 205, respectively, can move in the retracting directions 208, 209 and the extending directions 295, 297. The latch rods 201, 205 are shown in FIG. 12 in the fully retracted position. The linkage pins 240, 242 of the paddle handle 190 are, respectively, at distal ends 300, 302 of the slots 244, 246.

The catch of the bullet slam latch 196 is shown in FIG. 12 in the fully retracted position. The slot in the guide rod 260 acts in a similar fashion as the slots 244, 246 in the slide plates 192, 194 to allow the catch of the slam latch 196 to move to the retracted position without the necessity of actuating the operating lever 212 of the paddle handle 190. In operation, the catch engages the left door 38. Continued movement of the door 40 in the closing direction moves the catch to the retracted position. The spring disposed in the canister 262 of the bullet slam latch is compressed. Once the bullet slam latch 196 is aligned with the associated hole in the left door, the spring disposed in the canister 262 urges the catch to the extended position, thereby providing a third point of latching.

Figure 13:
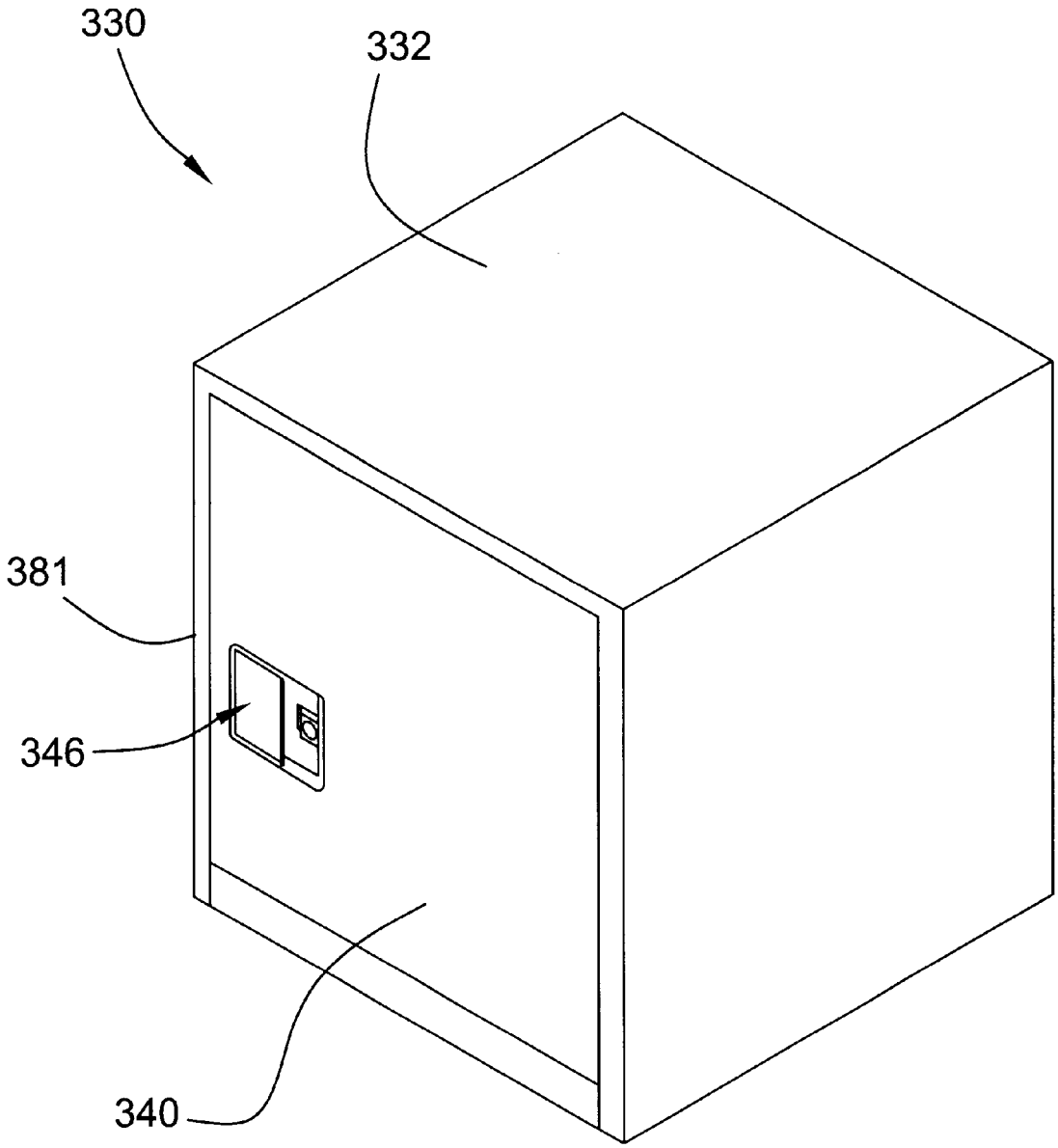
FIG. 13 is a perspective view of another embodiment of a safety cabinet.

Referring to FIG. 13, another embodiment of the safety cabinet 330 is shown. The safety cabinet 330 includes an enclosure 332 and a single door 340 having a latch system 346. The latch system 346 shown in FIG. 13 is similar to the latch system shown in FIGS. 1–12. Referring to FIG. 13, the catch of the bullet slam latch can be configured to engage the left jamb 381 of the enclosure 332 to latch the door 340 in the closed position.

Figure 14:
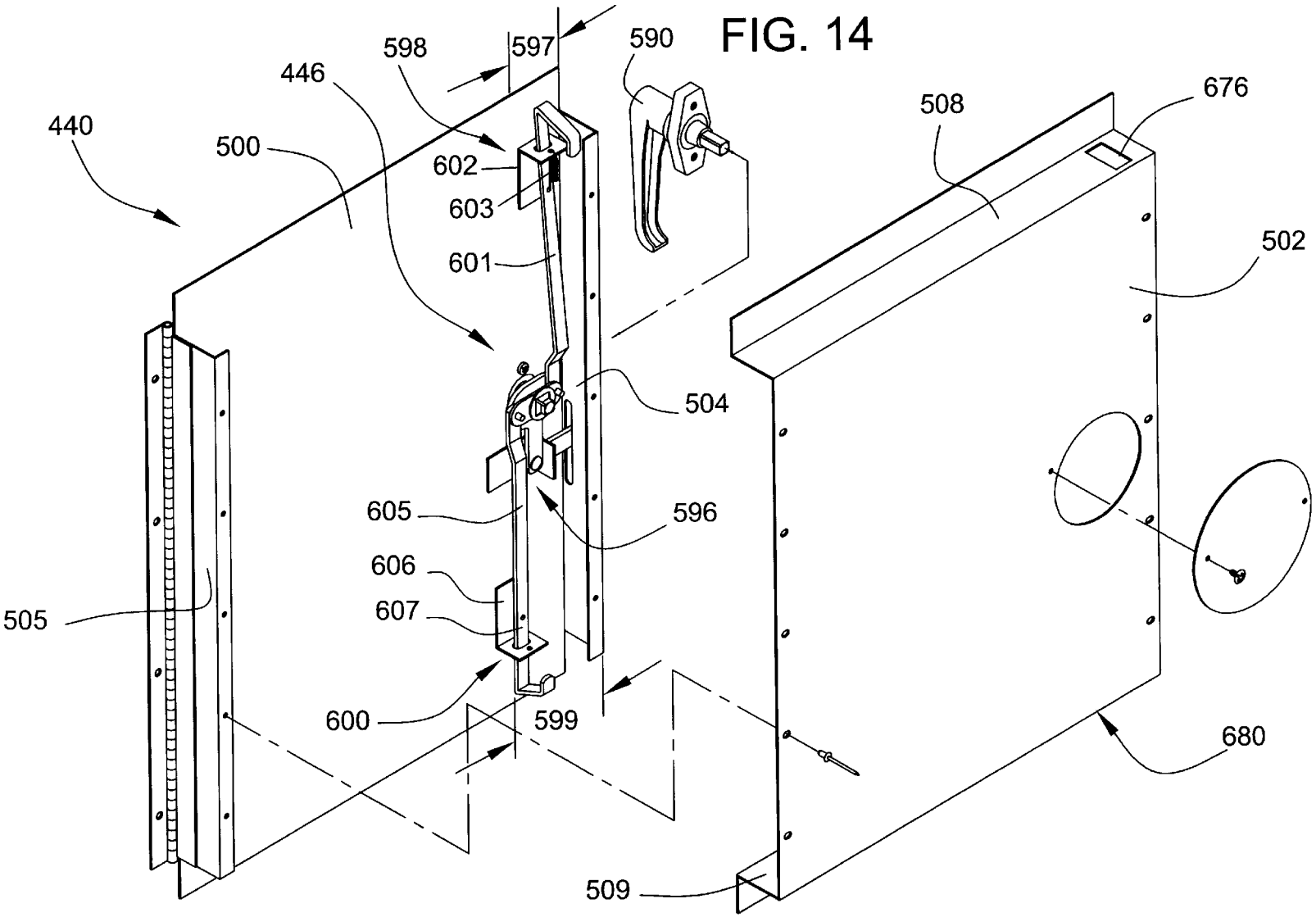
FIG. 14 is an exploded view of another embodiment of a door for a safety cabinet.

Referring to FIG. 14, another embodiment of a door 440 is shown. The door 440 is of construction similar to the right door 40 shown in FIGS. 1–12 and includes an outer door panel 500 and an inner door panel 502. The outer door panel 500 of the door 440 includes first and second side walls 504, 505. The inner door panel 502 of the door 440 includes a top wall 508 and a bottom wall 509. The first and second side walls 504, 505, the top wall 508, and the bottom wall 509 define an insulative air space bounded by the inner and outer door panels 500, 502 of the right door 440.

A latch system 445 is disposed in the door 440. The latch system 445 includes a handle 590, a cam latch 596, and first and second latch rod assemblies 598, 600. The first latch rod assembly 598 includes a first latch rod 601, a latch guide bracket 602, and a spring 603. The second latch rod assembly 600 includes a second latch rod 605, a latch guide bracket 606, and a spring 607. The first latch rod 601 is disposed a first distance 597 from the first side wall 594 of the door 440. The second latch rod 605 is disposed a second distance 599 from the first side wall 594 of the door 440. The door 440 can be installed in an enclosure which has apertures that align with the first and second latch rods 601, 605 to provide a latching feature.

Referring to FIG. 4, the latch system 46 can be adapted for use in the door 440 shown in FIG. 14. The length of the latch rods 201, 205 can be varied to fit within the door 440 shown in FIG. 14. The slide plates 192, 194 can be configured such that the first and second latch rods 201, 205 are disposed, respectively, the first distance 597 and the second distance 599 from the first side wall 594, as shown in FIG. 14, such that the latch rods 201, 205 can be disposed in the first and second openings 676, 680, respectively. The first and second openings 676, 680 are configured to align with upper and low latch apertures, respectively, disposed in the enclosure configured for use with the door 440 shown in FIG. 14. Thus, the slide plates of the latch system allow the latch rods to be mounted to the respective slide plates such that the latch rods are disposed in the first and second openings of the door and such that the latch rods can engage the latch apertures disposed in the enclosure. The slide plates 192, 194 allow the latch system 46 shown in FIG. 4 to be used in a safety cabinet manufacturing system which employs standard inner panels having and standard enclosures, for example, that can be used, for instance, with the latch system shown in FIG. 4 or FIG. 14.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A safety cabinet comprising:

an enclosure defining an opening;

a door rotatably attached to the enclosure, the door movable between an open position and a closed position, the door configured to cover at least a portion of the opening of the enclosure when in the closed position, the door including an outer surface, a recess, a first opening, a second opening, and a third opening; and a latch system ranged with the door to selectively retain the door in the closed position, including:

a paddle handle, the paddle handle disposed in the recess of the door such that the paddle handle is substantially flush with the outer surface of the door, the paddle handle having an operating lever to actuate the latch system, first and second slide plates, the first and second slide plates moveably mounted so as to respond to actuation of the operating lever, first and second latch rods, the first and second latch rods respectively mounted to the first and second slide plates, the latch rods being moveable between an extended position and a refracted position, the first and second latch rods being configured to engage the enclosure to selectively retain the door when in the closed position, the latch rods being biased to the extended position such that a portion of the first and second latch rods projects from the first and second openings, respectively, of the door, the latch rods moving to the retracted position upon actuation of the paddle handle, and a bullet slam latch mounted to the paddle handle, the bullet slam latch having a catch, the catch being moveably mounted so as to respond to actuation of the paddle handle and moveable between an extended position and a retracted position, the catch being biased to the extended position such that the catch projects from the third opening of the door, the catch being configured to selectively retain the door when in the closed position, the catch moving to the retracted position upon actuation of the paddle handle, and wherein the latch system is configured such that the door is movable from the open position to the closed position without the actuation of the paddle handle, and the first and second slide plates are movable without the actuation of the paddle handle in response to movement of the first and second latch rods, respectively, from the extended position to the retracted position.

2. The safety cabinet as described in claim 1 wherein the enclosure comprises a double-walled construction.

3. The safety cabinet as described in claim 2 wherein the enclosure includes a floor portion defining a sump area for retaining fluid.

4. The safety cabinet as described in claim 1 wherein the door comprises an outer panel and an inner panel that define an insulative air space.

5. The safety cabinet as described in claim 1 wherein the door includes a first side wall, and the first and second slide plates are configured such that the first and second latch rods are disposed, respectively, a first distance from the first side wall and a second distance from the first side wall such that the latch rods can be respectively disposed in the first and second openings of the door.

6. The safety cabinet as described in claim 1 wherein the paddle handle includes a first handle linkage and an opposing second handle linkage, the first and second handle linkages being pivotally mounted such that actuating the operating lever rotates distal ends of the handle linkages toward each other, the first and second handle linkages each including a linkage pin, and the first and second slide plates each includes a slot, each slot of the first and second slide plates having a respective linkage pin of the first and second handle linkages disposed therein to slidably mount the first and second slide plates to the first and second handle linkages, respectively.

7. The safety cabinet as described in claim 1 wherein first and second springs are cooperatively arranged with the first and second latch rods, respectively, to bias the first and second latch rods to the extended position.

8. The safety cabinet as described in claim 7 further comprising:

first and second latch guide brackets, the first and second latch guide brackets being cooperatively arranged with the first and second latch rods, respectively, each guide bracket being mounted to the door and including an aperture with the respective latch rod extending therethrough, the first spring being mounted to the first latch rod and the first latch guide bracket, and the second spring being mounted to the second latch rod and the second latch guide bracket.

9. The safety cabinet as described in claim 1 wherein the bullet slam is configured to engage the enclosure.

10. The safety cabinet as described in claim 1 further comprising:

a closure system operably arranged with the door to bias the door to the closed position.

11. The safety cabinet as described in claim 10 wherein the closure system comprises a linkage and an air cylinder having a moveable piston, the linkage being mounted to the door and rotatably mounted to the piston, the air cylinder being rotatably mounted to the enclosure, and the air cylinder being configured such that the piston acts to bias the door to the closed position.

12. The safety cabinet as described in claim 1 further comprising:

a retaining system to selectively retain the door in the open position.

13. The safety cabinet as described in claim 10 further comprising:

a retaining system to selectively retain the door in the open position, the retaining system having a fusible link, the fusible link mounted to the door and the enclosure, the fusible link being constructed such that the fusible link will fuse when the ambient temperature is above a selected level to thereby detach the link from the enclosure to allow the closure system to move the door to the closed position.

14. The safety cabinet as described in claim 13 wherein the fusible link is constructed such that the fusible link will fuse when the ambient temperature is 165° F.

15. The safety cabinet as described in claim 1 further comprising:

a second door rotatably attached to the enclosure, the second door being rotatable between an open position and a closed position, the doors, when in the closed position, cooperating with each other to cover the opening of the enclosure.

16. The safety cabinet as described in claim 15 wherein the second door includes a baffle.

17. The safety cabinet as described in claim 15 wherein the bullet slam is configured to engage the second door.

18. The safety cabinet as described in claim 15 further comprising:

a closure system operably arranged with the doors to bias the doors to the closed position, the closure system including a timing mechanism mounted to the enclosure to control the sequence of the closing of the doors such that the second door is placed in the closed position before the other door.

19. The safety cabinet as described in claim 1 wherein the paddle handle includes a lock for selectively retaining the operating lever to prevent the actuation of the paddle handle.

20. The safety cabinet as described in claim 1 wherein the door includes an access hole covered by a removable cover plate.

21. A safety cabinet comprising:

an enclosure defining an opening and a cavity;

a door rotatably attached to the enclosure, the door being rotatable between an open position and a closed position, the door, when in the closed position, covering at least a portion of the opening of the enclosure, the door including a first side wall, an outer surface, a recess, a first opening, and a second opening;

a closure system operably arranged to bias the door to the closed position;

a retaining system operably arranged to selectively retain the door in the open position; and a latch system operably arranged to selectively retain the door in the closed position, including:

a paddle handle, the paddle handle disposed in the recess of the door such that the paddle handle is substantially flush with the outer surface of the door, the paddle handle having an operating lever which is moveable to an operating position to actuate the latch system, the paddle handle including a pair of pins, first and second slide plates, the first and second slide plates moveably mounted to the paddle handle, each slide plate including an elongated slot each receiving one of said pair of pins of the paddle handle, the first and second slide plate each moveable over a selected range of travel with respect to the one of said pair of pins of the paddle handle received therein, first and second latch rod assemblies, the first and second latch rod assemblies each including a respective first and second latch rod cooperatively arranged with a first and second spring, the first and second latch rods respectively mounted to the first and second slide plates, the latch rods being moveable between an extended position and a retracted position, the first and second springs configured to bias the respective first and second latch rods to the extended position, the first and second latch rods each configured to engage the enclosure to selectively retain the door in the closed position, and a bullet slam latch mounted to the paddle handle so as to respond to actuation of the paddle handle, the bullet slam latch having a catch, the bullet slam latch having a slot for movably mounting the catch such that the catch is movable between an extended position and a retracted position, the catch being biased to the extended position, the catch being configured to selectively retain the door when in the closed position, the catch moving to the retracted position upon actuation of the paddle handle, and wherein the slots of the first and second slide plates and the slot of the catch are respectively configured such that the first and second latch rods and the catch are movable toward the retracted positions so as to allow the door to be movable from the open position to the closed position without the actuation of the paddle handle.

* * * * *